United States Patent [19]

Morgan

[11] 4,319,994

[45] Mar. 16, 1982

[54] GOLD MINING PAN

[76] Inventor: Ralph H. Morgan, 1363 Kingfisher, #3, Sunnyvale, Calif. 94087

[21] Appl. No.: 151,276

[22] Filed: May 19, 1980

[51] Int. Cl.[3] ..... B03B 5/04

[52] U.S. Cl. ..... 209/447; 209/495

[58] Field of Search ..... 209/447, 490, 494, 495, 209/445, 446, 506

[56] References Cited

U.S. PATENT DOCUMENTS

| | | | |
|---|---|---|---|
| 470,018 | 3/1892 | Strong | 222/130 |
| 533,834 | 2/1895 | Wind | 222/275 |
| 906,464 | 12/1908 | Sherwood | 209/494 |
| 1,004,412 | 9/1911 | Gilchrist | 209/494 |
| 2,484,203 | 10/1949 | Beck | 209/446 |
| 2,630,226 | 3/1953 | Streng | 209/447 |

*Primary Examiner*—Ralph J. Hill

*Attorney, Agent, or Firm*—Claude A. S. Hamrick

[57] ABSTRACT

A gold mining pan having riffle-like slits or grooves in the bottom and a device for separating the material contained in the slits or grooves from the remainder of a slurry contained within the pan. The pan may also include a device for removing the material contained within the slits from the pan.

9 Claims, 5 Drawing Figures

GOLD MINING PAN

BACKGROUND OF THE INVENTION

1. Field of the Invention

The present invention relates generally to gold mining apparatus and more particularly to a novel gold mining pan having means for improving the efficiency of the panning operation.

2. Description of the Prior Art

Heretofore the manual panning of gold from stream beds has been accomplished using metal pans of various configurations but generally consisting of a flat bottom with sides obliquely sloped away from the vertical so as to enable a slurry of water and sand to be swirled around in the pan. The purpose of the swirling action is to keep the sand particles in suspension in the water and allow the heavier gold particles to settle to the bottom of the pan. As the sand suspension is swirled in the pan, the pan is tilted slightly so as to allow the slurry to exit over the side of the pan leaving any gold which may have precipitated out in the bottom of the pan. This is of course a relatively long and arduous procedure and one that involves considerable skill and dexterity if one is to separate substantially all of the sand from any gold dust or gold particles which may have precipitated to the bottom of the pan. Although the gold dust settles to the bottom of the pan during the first few swirls of the slurry, it takes numerous swirls to eject the majority of the sand leaving only the gold behind. Accordingly, the use of such devices to effect separation without also dumping gold dust involves backbreaking work and requires a considerable amount of time.

SUMMARY OF THE PRESENT INVENTION

It is therefore a principal objective of the present invention to provide an improved gold mining pan which enables gold dust and/or gold bearing particles to be quickly isolated from a water and sand slurry.

Another objective of the present invention is to provide a gold mining pan having means for expediting the removal of any gold bearing particles from a slurry.

Still another objective of the present invention is to provide a gold mining pan having means for enabling the gold catch areas of the pan to be viewed from beneath to determine whether or not there is gold bearing material therein.

Briefly, in accordance with the present invention, a pan is provided having riffle-like slits or grooves in the bottom and means for separating the material contained in the slits or grooves from the remainder of the slurry contained within the pan. Furthermore, the device may also include a means for removing the material contained within the slits from the pan.

A principle advantage of the present invention is that once the initial gold separating swirling action has been accomplished, the separated gold particles can be removed from the pan and the remaining sand and water dumped therefrom so that the device can be made ready to reload another quantity of materials to be separated.

These and other objects and advantages of the present invention will no doubt become apparent to those of ordinary skill in the art after having read the following detailed description of the preferred embodiments.

IN THE DRAWING

DETAILED DESCRIPTION OF THE PREFERRED EMBODIMENT

Figure 1:
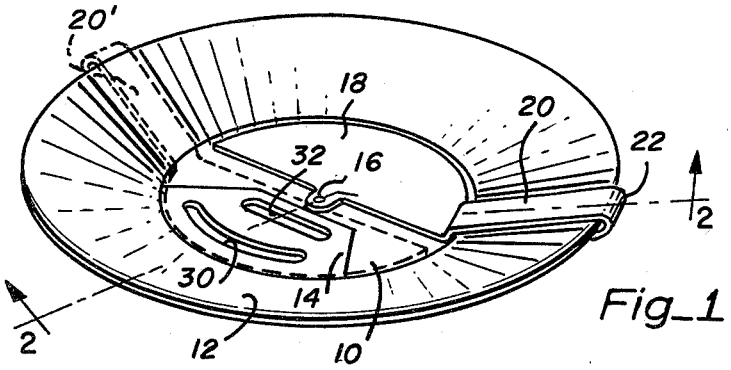
FIG. 1 is a perspective view illustrating the upper portion of a gold mining pan in accordance with the present invention.
Figure 2:
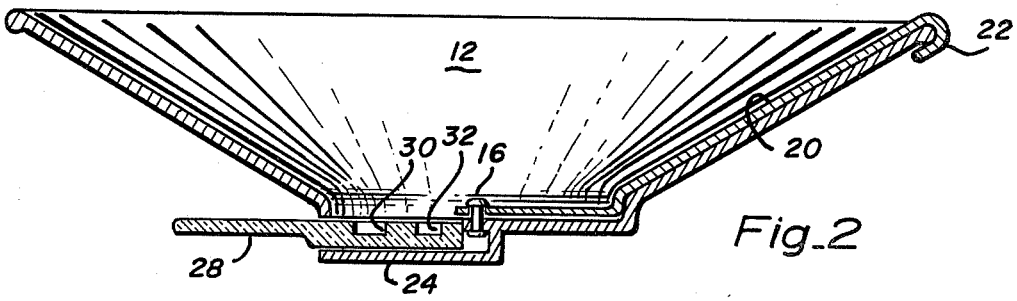
FIG. 2 is a cross section taken along the lines 2—2 of FIG. 1.
Figure 3:
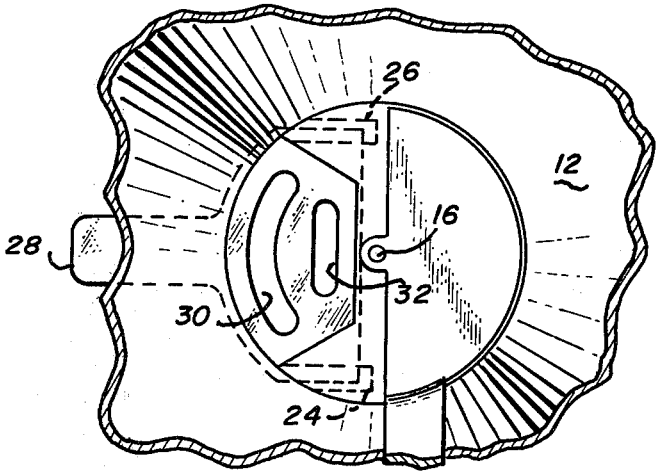
FIG. 3 is a partial plan view showing the central portion of the pan illustrated in FIGS. 1 and 2.

Referring now to FIGS. 1, 2 and 3 of the drawing there is shown a gold mining pan of the typical saucer-like configuration having a circular bottom 10 and flared side walls 12. Bottom 10 has a segment removed therefrom so as to provide an opening 14 therein. Pivotally affixed the center of bottom 10 by means of a pivot pin 16 is a closure plate 18 having a handle 20 which extends up along the side wall 12 with the tip 22 being folded over the upper edge of the wall to provide a finger grip.

As shown, the closure plate 18 may be revolved about pivot pin 16 by moving handle 20 into the position illustrated by the dashed lines 20' thereby covering the opening 14.

Disposed beneath the bottom 10 and slidably received within a pair of edge guides 24 and 26 is a slide member 28 having a plurality of riffles or grooves 30 and 32 formed in the upper surface thereof. When in the position illustrated, the slide member 28 closes the opening 14. Slide member 28 is preferably made of a clear glass or plastic material so as to enable one to look through the bottom thereof and view the contents of the grooves 30 and 32. Member 28 can be removed from its slides by simply pulling it in the leftward direction as illustrated until its end clears the slides 24 and 26.

In operation, one positions the handle 20 in the position illustrated in FIG. 1 such that the opening 14 is uncovered and places the slide member 28 in its illustrated position closing opening 14 at the bottom. A quantity of a potentially gold bearing slurry of water and sand is then placed in the pan and the pan is held tipped slightly from horizontal and moved with a swirling action causing the sand to become suspended in the water and swirl about the interior of the pan. Since any gold particles contained within the slurry will be substantially more dense and thus heavier than the sand particles, they will tend to quickly settle to the bottom of the pan and become lodged in the grooves 30 and 32.

If this were an ordinary pan, one would then continue to swirl the pan until most of the sand and water had been ejected over a lip thereof leaving only the gold and a small quantity of sand in the bottom. However, in accordance with the present invention, after one has swirled the slurry several times allowing the gold to precipitate downwardly and into slots 30 and 32, the handle 20 is moved into the position shown by the dashed lines 20' so as to close opening 14 and separate the gold bearing sand from the balance of the material contained within the pan. Slide member 28 is then removed from its cradled position beneath the pan and is dipped in a bucket of water to as to allow any gold particles and sand contained within the grooves 30 and 32 to drop into the bucket. Slide member 28 is thereafter reinserted into its position beneath the pan and handle 20 is moved back into its initial position and the operation is repeated. After completion of the days panning operation, the gold dust contained within the wash bucket can later be conveniently separated from the residual sand using any of several well known techniques.

As will be readily understood by those skilled in the art, the operation just described substantially decreases the amount of time and effort required to separate gold bearing sand from ordinary sand and thus substantially improves the efficiency of the panning operation.

Figure 4:
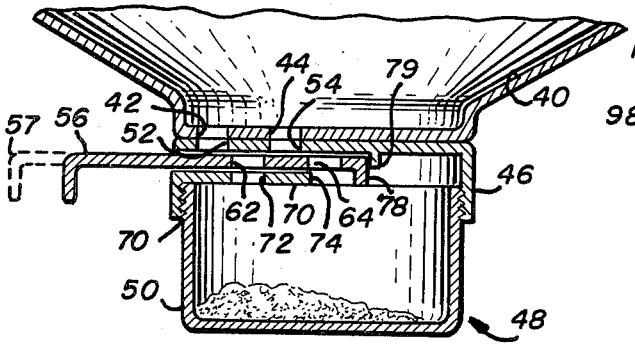
FIG. 4 is a partial cross sectional view illustrating an alternative embodiment of the present invention.

Turning to FIG. 4 of the drawing, which is a partial diagonal cross section taken through an alternative embodiment of the present invention, there is shown an ordinary pan device 40 having slots 42 and 44 provided therein which are similar in plan view to those illustrated at 30 and 32 in FIGS. 1–3. Affixed to the bottom of pan 40 is a closure member 46 forming part of a container generally illustrated at 48 and further including a lower cup member 50. Member 46 is provided with a pair of slots 52 and 54 which are aligned with corresponding slots 42 and 44.

Disposed immediately beneath the upper portion of cover member 46 is a slide plate 56 which also contains apertures 62 and 64 that dimensionally correspond to the apertures 52 and 54. However, when the slide 56 is in the fully inserted position illustrated, the slots 62 and 64 are not aligned with the openings 52 and 54 respectively, and the upper surface of slide 56 combines with the openings 42–52 and 44–54 to provide gold particle collecting grooves similar to those illustrated in FIGS. 1–3.

Disposed beneath slide 56 and serving as a support therefor is a semi-circular flange 70 having an aperture 72 which is configured to correspond to the aperture 62 and which is aligned therewith when slide member 56 is in the position illustrated. The innermost edge 74 of flange 70 is dimensioned to correspond with the outer most edge of slot 64 when slide 70 is in the illustrated position. The cup 52 is threadably attached at 76 to the bottom flanges of closure member 46 as illustrated.

The innermost extremity of slide 56 is configured to include a downwardly extending tab 78 which is adapted to engage edge 74 of flange 70 to provide a limit stop for leftward movement of slide 56, and to engage a tab 79 extending downwardly from the lower surface of closure member 46 which provides a limit stop for rightward movement of slide 56.

It will thus be appreciated that after the gold pan has been swirled several times as described above, any gold contained therein will be captured within the grooves 42–52 and 44–54. By moving the slide member 56 to the left and into the position shown by the dashed lines 57 so as to align openings 62 and 64 with openings 42–52 and 44–54 respectively, and then back to the right, such gold dust can be selectively shifted rightwardly and be deposited into the cup 50 through the openings 72 and 74. This enables one to quickly separate out any gold dust contained within the panned slurry. This embodiment could also include an equivalent of the blade 18 discussed above so as to assist in separating the bulk of the sand material from the gold bearing material but such is not deemed necessary in the usual case.

Figure 5:
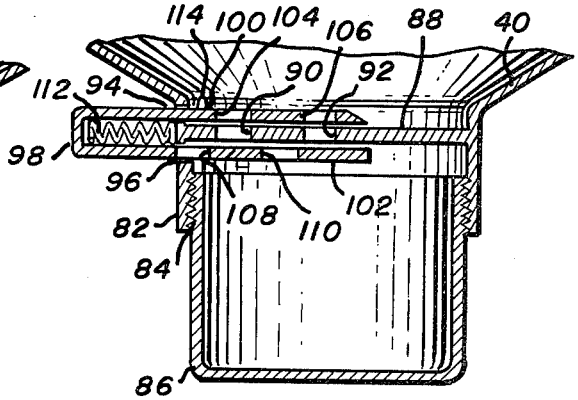
FIG. 5 is a partial cross sectional view illustrating another alternative embodiment of the present invention.

Another alternative embodiment of the present invention is shown in FIG. 5 and differs from the FIG. 4 embodiment primarily in that instead of pulling the slide member to effect deposition of gold dust into a container, the slide member is pushed. More particularly, the bottom of the gold pan 80 is configured to have a downwardly extending circular flange 82 which is threaded on its interior surface at 84 to threadably mate with a gold collecting cup 86. The pan bottom 88 is provided with openings 90 and 92 which in plan view resemble the grooves 30 and 32 shown in FIG. 3. A lateral slot 94 is provided in pan 80 proximate the top surface of bottom 88 and a similar slot 96 is provided in flange 82 proximate the bottom surface of pan bottom 88. Extending through the slots 94 and 96 is a slide member 98 having similarly configured upper and lower portions 100 and 102 respectively which in plan view are similar to that of slide member 28 shown in FIG. 3. Upper member 100 has a pair of slots 104 and 106 provided therein which are configured similar to and are aligned with the slots 90 and 92 respectively when slide member 98 is in the position illustrated. The lower portion 102 is provided with similar slots 108 and 110 which are offset leftwardly so as to align with slots 90 and 92 when slide member 98 is pushed fully inwardly to a limit determined by full compression of a spring 112 which also serves to return member 98 to the position illustrated. A stop tab 114 is provided on upper portion 100 to engage the side of pan 80 and provide a limit stop for movement of member 98 in the leftward direction.

In operation, one would fill the pan with a slurry of sand and water, swirl the pan and slurry as described above until gold bearing particles have had an opportunity to migrate into the grooves formed by the openings 104–90 and 106–92, and then push slide 98 rightwardly so that slots 108 and 110 align with slots 90 and 92 and allow gold dust contained therein to drop through the slots 108 and 110 into the container 86. If more dust is contained within the upper layer of the two layer groove illustrated, it will be appreciated that a second push rightwardly of slide 98 will allow that which was on the first actuation carried rightwardly in slots 108 and 106 to now drop into slots 90 and 92 and then through slots 108 and 110.

Although a preferred embodiment and two alternative embodiments have been disclosed above, it is contemplated that other alterations and modifications of the invention will become apparent to those skilled in the art after having read the above disclosure. For example, instead of sliding within guide slots or brackets as illustrated, the slide member could be pivotally attached to the pan bottom so that it can be rotated from a collection position to a discharge position. It is therefore intended that the appended claims be interpreted as covering all such alterations and modifications as fall within the true spirit and scope of the invention.

What is claimed is:

1. A gold mining pan comprising:

pan forming means including a circular bottom portion and a circumscribing outwardly flared frustoconically configured wall portion, said bottom portion having an opening formed in an arcuate segment thereof;

slide means disposed beneath said arcuate segment and including an arcuate groove formed in the surface thereof facing said arcuate segment; and means affixed to said bottom portion for holding the upper surface of said slide means in contact with the bottom surface of said bottom portion when said groove is in registration with said arcuate opening, whereby when said pan is swirled the more dense material included in a slurry contained within said pan is caused to be separate from the remainder of the slurry and be collected within said groove and such material may be extracted by removing said slide means.

2. A gold mining pan comprising:

means including a circular bottom portion and an outwardly flared frusto-conically configured wall portion;

said bottom portion including at least one elongated opening formed in an arcuate portion near the outer perimeter thereof through which the more dense materials of a sand and water slurry contained within said pan may pass when said pan is swirled, and slide means disposed beneath said opening for receiving and removing the more dense material which precipitates from said slurry and becomes trapped in said elongated opening.

3. A gold mining pan as recited in claim 1 and further comprising a plate means attached to the upper surface of said bottom portion and moveable into a position to cover said opening to prevent the contents of said pan from dropping therethrough when said slide member is removed.

4. A gold mining pan as recited in claim 1 wherein slide member is transparent so as to allow material contained within said elongated opening to be inspected from beneath.

5. A gold mining pan as recited in claim 1 wherein said slide means for removing material includes a slide member disposed beneath said bottom portion to form a closure for said elongated opening and having a slot formed therein which is normally out of registration with said opening but which registers with said opening when said slide member is moved into a discharge position so as to permit material contained within said elongated opening to drop through said slot.

6. A gold mining pan as recited in claim 5 and further comprising:

container means affixed to said bottom portion for collecting materials dropping through said slot.

7. A gold mining pan comprising:

means including a circular bottom portion and an outwardly flared frusto-conically configured wall portion;

said bottom portion including at least one elongated opening formed in an arcuate portion near the outer perimeter thereof through which the more dense materials of a sand and water slurry contained within said pan may pass when said pan is swirled, and slide means disposed beneath said opening for receiving and removing the more dense material which precipitates from said slurry and becomes trapped in said elongated opening;

said bottom portion including a downwardly extending annular flange, and wherein a first slot is formed in said wall portion immediately above said bottom portion and a second slot is formed in said annular flange immediately below said bottom portion, and wherein said slide means for removing material includes a slide member having an upper plate adapted to extend through said first slot and into position above said bottom portion, and a lower plate adapted to extend through said second slot and into position beneath said bottom portion, said upper plate including an opening therein configured to align with said elongated opening when said slide member is in a first position and said lower plate including an opening therein configured to align with said elongated opening when said slide member is in a second position.

8. A gold mining pan as recited in claim 7 wherein said means for removing material further includes means for resiliently biasing said slide member into said first position.

9. A gold mining pan as recited in claim 7 and further comprising a container means adapted to threadably engage said annular flange so as to receive material contained within said groove each time said slide member is moved from said first position to said second position.

* * * * *